United States Patent [19]

Burnham

[11] 4,244,057

[45] Jan. 13, 1981

[54] NASAL DRIP ABSORBING DEVICE

[76] Inventor: Louise S. Burnham, 11 Blithedale Ter., Mill Valley, Calif. 94941

[21] Appl. No.: 57,756

[22] Filed: Jul. 16, 1979

[51] Int. Cl.[3] ..... A41D 27/12

[52] U.S. Cl. ..... 2/160; 2/170; 24/3 A; 24/15; 428/100; 428/99; 128/296

[58] Field of Search ..... 2/160, 167, 161 R, 161 A, 2/DIG. 6, 159, 170; 128/296; 428/99, 100; 24/3 A, 15

[56] References Cited

U.S. PATENT DOCUMENTS

| | | | |
|---|---|---|---|
| 1,139,942 | 5/1915 | Wightman et al. | 24/3 A |
| 1,426,797 | 8/1922 | Wangelin | 2/160 |
| 2,067,537 | 1/1937 | Kost et al. | 24/3 A |
| 2,432,325 | 12/1947 | McDougall | 2/160 |
| 2,579,275 | 12/1951 | Schworm | 128/296 |
| 3,421,160 | 1/1969 | Domenico | 2/159 |
| 3,589,367 | 6/1971 | Sease | 128/296 |
| 4,094,014 | 6/1978 | Schroeder | 2/161 R |

FOREIGN PATENT DOCUMENTS

| | | | |
|---|---|---|---|
| 532694 | 7/1954 | Belgium | 2/160 |

*Primary Examiner*—George F. Lesmes
*Assistant Examiner*—Alexander S. Thomas
*Attorney, Agent, or Firm*—Owen, Wickersham & Erickson

[57] ABSTRACT

A nasal drip absorbing device for use in cold weather includes an absorbent pad with a removable connection member at its underside, cooperative with a matching attachment member permanently secured to an article of clothing, so that the pad may be readily attached to and detached from the article. The article of clothing is an outer garment worn in cold weather, such as a glove or a coat sleeve, or it may be an elastic band which may be worn over the sleeve or the glove. The absorbent pad may be of washable fabric or of a disposable material such as layered paper.

7 Claims, 5 Drawing Figures

FIG. 1
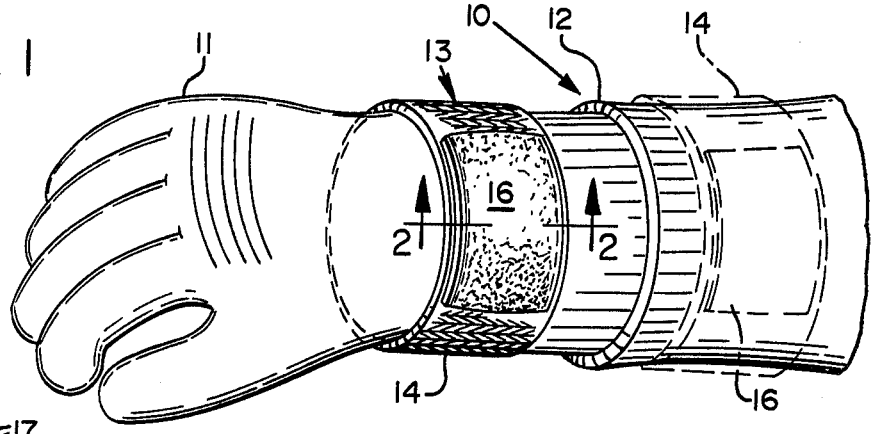
FIG. 2
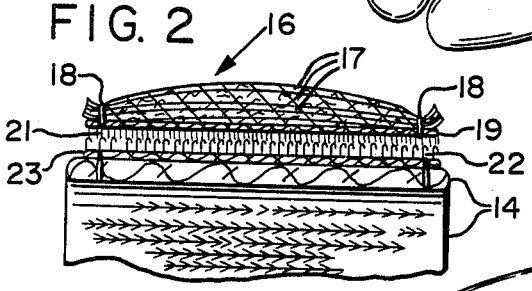
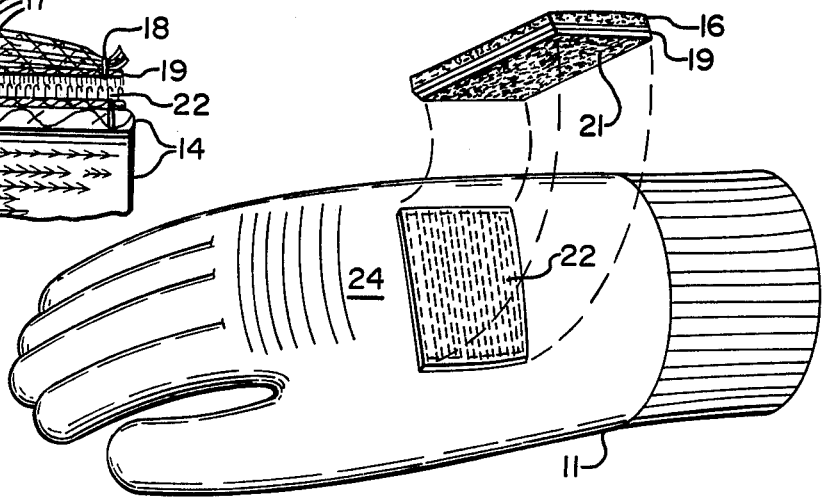
FIG. 3
FIG. 4
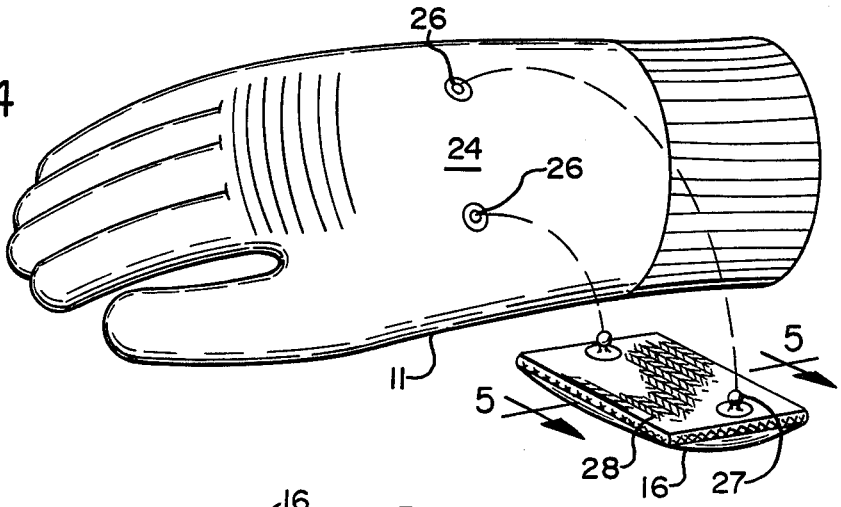
FIG. 5
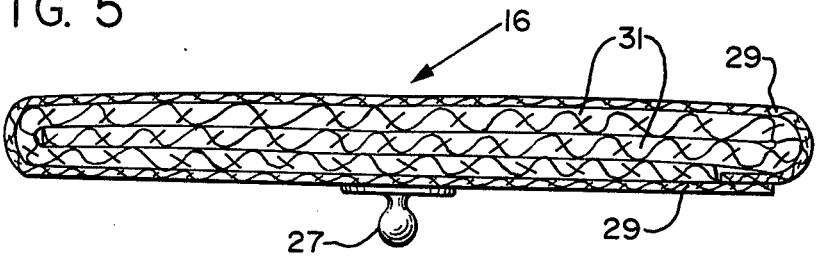

NASAL DRIP ABSORBING DEVICE

BACKGROUND OF THE INVENTION

The invention relates to nasal drip absorption means, and more particularly to an absorbent pad which may be attached to an article of clothing, preferably removably.

In cold weather activities such as snow skiing, tobogganing and the like, the nose tends to discharge fluid. However, the person involved in the activity is normally wearing gloves, a coat and other heavy apparel, and must remove his glove and sometimes open his coat in order to retrieve a handkerchief or tissue paper for absorbing the nasal drip. This is not only inconvenient, but sometimes impossible, as when the person is skiing or otherwise unable to go through such procedure.

There has therefore been a need among pursuers of outdoor winter activities for some means of wiping the nose conveniently without removing clothing. Such an item has heretofore been unavailable.

The only relevant prior art of which the applicant is aware is a terrycloth wrist band for tennis players, including elastic material, intended for absorbing arm perspiration or for wiping the player's brow or eyes of perspiration when required. The terrycloth band is for warm weather use only. In cold weather, any moisture in a terrycloth band would tend to freeze, at least at the outer, more exposed portions of the fabric. Thus, such an item could not function as a nasal drip absorber for winter use, i.e. a cold weather nosewipe.

SUMMARY OF THE INVENTION

The present invention provides a convenient and effective device for cold weather activities such as skiing. An absorbent pad, either disposable or washable, is attached to an article of outer clothing, such as a coat, a glove or a parka connected to a coat. The garment is preferably one covering an arm or hand, and it may be a stretchable wrist or arm band provided for this purpose and suitable for wearing over a glove or coat sleeve.

Although the absorbent pad, in its washable form, may be sewn onto a washable garment such as a washable glove or jacket or even a shirt, it is preferably very easily detachable so that it can be separately washed, or thrown away in the case of the disposable form. The connection means can comprise a hooked and looped fabric construction such as that sold under the trademark "Velcro", or any other convenient and simple attaching device such as snaps or even buttons or a zipper. When the pad becomes saturated, the user simply removes it and installs another.

Accordingly, in one embodiment the nasal drip absorbing device of the invention, for cold weather use when the user's nose tends to drip, comprises, in combination with an article of outer clothing a water-washable absorbent pad secured to the article of clothing in such a position as to be conveniently applied to the user's nose, such article of clothing also being water-washable and adapted to be worn on one of the upper appendages of the user, whereby the user can absorb nasal drip in the pad conveniently without reaching into a pocket for other absorbing material.

It is therefore among the objects of the invention to provide a heretofore unavailable product for outdoor winter use, for convenient absorption of nasal drip without the need to remove gloves to reach a handkerchief.

These and other objects, advantages and features of the invention will be apparent from the following description of the preferred embodiments, taken in conjunction with the accompanying drawings.

DESCRIPTION OF THE DRAWINGS

FIG. 1 is a view showing a nasal drip absorbing device according to the invention, incorporated in an arm band and worn over outer winter clothing.

FIG. 2 is a sectional view of the arm band taken along the line 2—2 of FIG. 1, with an absorbent pad, and illustrating a removable attachment means between the band and the pad.

FIG. 3 is a view showing the pad removably attached to a glove.

FIG. 4 is a view similar to FIG. 3, showing snaps as the attachment means.

FIG. 5 is a sectional view of one form of removable absorbent pad, taken along the line 5—5 of FIG. 4.

DESCRIPTION OF THE PREFERRED EMBODIMENTS

In the drawings, FIG. 1 shows a user's arm 10, wearing winter garments including a glove 11 and a relatively heavy coat having a sleeve 12. The user is generally engaged in some outdoor winter activity such as skiing, hockey, tobogganing, snowmobiling, morning jogging, bicycling, or even an occupational activity. Over the user's glove or sleeve is worn a nasal drip absorbing device 13 according to the invention, including an arm band 14 and a removably attached absorbent pad 16. The arm band 14 preferably is stretchable, including elastic material so that it may easily be slipped over the hand and onto the wrist or arm, over the gloove 11 or the coat sleeve 12 (shown in dashed lines on the coat sleeve 12 in FIG. 1). The absorbent pad 16 is easily removable from the arm band 14, and is either disposable or washable in water, so that it can be reused.

If disposable, the pad 16 may take the form illustrated in FIG. 2, comprising layered absorbent paper as is typical of the internal construction of disposable diapers. All layers are absorbent, and the internal layers 17 are of a very absorbent cottony tissue so that they tend to draw fluid inwardly as in diaper construction. These layers are connected, as by stitching 18, to a backing sheet 19 having some form of removable attachment means 21 on its underside.

The stretchable band 14 has affixed to it a cooperating securing means 22, for engaging the attachment means 21 in a readily detachable connection. Such cooperating swatches of attachment material 21 and 22 are preferably flexible hook material and looped pile fabric material of the type marketed and commonly known under the trademark "Velcro". The hook material preferably comprises the securing means 22 on the arm band 14, as illustrated in FIG. 2, with the looped pile fabric material 21 being at the underside of the pad 16. The hook material 22 has a backing 23 which may be stitched or appropriately adhered to the surface of the arm band 14.

As illustrated in FIG. 3, the absorbent pad 16 with its removable attachment means 21 may be connected to the back side 24 of the glove 11 itself, with the securing means 22 affixed directly to the glove as shown, rather than to an arm band 14. Again, the pad 16 may comprise the disposable construction shown in FIG. 2 or a water-washable cloth material. Also, the swatch 22 of securing material, such as the flexible hook material illustrated, may be positioned in other convenient locations on outer garments, in such a position as to be conveniently applied to the user's nose. Thus, the securing means 22 can be affixed to a coat sleeve, approximately in the position the arm band 14 is shown (dashed lines) in FIG. 1, or even on a parka attached to the coat.

If desired, the pad 16 in its water-washable form may be secured permanently to an article of water-washable clothing such as a washable glove or coat, although the removable form is preferred.

FIGS. 4 and 5 show the use of snap fasteners 26 and 27 for removably securing the pad 16 to the back side 24 of the glove 11, or to another convenient spot on another garment such as a coat sleeve. The female snap fittings 26 are preferably secured directly to the glove 24 or other garment, with the male snap fittings 27 extending from the underside of the pad 16, preferably being attached to a backing 28. Preferably at least two snaps are included, for stability of position.

FIG. 5 shows a form the absorbent pad 16 may take when it is of the water-washable construction. It may comprise an absorbent cloth upper layer 29 and internal layers 31 of highly absorbent cloth material, all washable in water. As indicated, the outer cover 29 may serve as a backing for the male snap fittings 27, which may be secured to the material 29 in a conventional manner.

The above described preferred embodiments provide several forms of a nasal drip absorbing device which enables one engaged in skiing or other cold-weather activities to absorb nasal drip without removing a glove or other outer garment. Various other embodiments and variations to these preferred embodiments will be apparent to those skilled in the art and may be made without departing from the spirit and scope of the following claims.

I claim:

1. In combination with an article of outer clothing, a nasal drip absorbing device for use in cold weather when the user's nose tends to drip, comprising:

fixed securing means connected to the article of clothing, such article adapted to be worn on one of the upper appendages of the user; and a disposable absorbent pad formed of multiple layers of absorbent tissue and a backing sheet secured to the layers at their underside, said backing sheet having permanently secured to its underside removable attachment means removably attached to the fixed securing means to permit easy detachment of the pad from the article of clothing and re-attachment of a new disposable absorbent pad;

whereby the user can absorb nasal drip in the pad conveniently without reaching into a pocket for other absorbent material, and may replace the disposable absorbent pad whenever necessary.

2. The nasal drip absorbing device of claim 1 wherein the article of clothing is a coat, the fixed securing means being affixed to a sleeve of the coat.

3. The nasal drip absorbing device of claim 1 wherein the article of clothing is a glove, the fixed securing means being affixed to the back side of the glove.

4. The nasal drip absorbing device of claim 1 wherein the article of clothing is a stretchable band adapted to be worn on the arm of the user, including elastic material for secure retention of the band on the arm.

5. The nasal drip absorbing device of claim 1 wherein the fixed securing means and the removable attachment means comprise Velcro material.

6. A nasal drip absorbing device for use in cold weather when the user's nose tends to drip, comprising:

a stretchable band adapted to be worn on the arm of the user and capable of being worn over other outer garments, the band including elastic material for secure retention of the band on the arm;

securing means permanently affixed to the outer side of the stretchable band; and a disposable absorbent pad formed of multiple layers of absorbent tissue and a backing sheet secured to the layers at their underside, said backing sheet having secured to its underside removable attachment means for removable connection to the fixed securing means, so that the user can readily attach the pad to and detach the pad from the stretchable band and replace the pad with a new disposable absorbent pad whenever necessary;

whereby the user can absorb nasal drip conveniently in the pad without reaching into a pocket for other absorbing means and without removing any article of clothing.

7. The nasal drip absorbing device of claim 6 wherein the securing means and the removable attachment means comprise Velcro material.

* * * * *